US006144162A

United States Patent [19]

Smith

[11] Patent Number: 6,144,162

[45] Date of Patent: Nov. 7, 2000

[54] CONTROLLING POLYMER DISPLAYS

[75] Inventor: Ronald D. Smith, Phoenix, Ariz.

[73] Assignee: Intel Corporation, Santa Clara, Calif.

[21] Appl. No.: 09/301,182

[22] Filed: Apr. 28, 1999

[51] Int. Cl.[7] ..... G09G 3/10

[52] U.S. Cl. ..... 315/169.1; 315/169.3; 315/169.4; 345/214

[58] Field of Search ..... 315/169.1, 169.3, 315/169.4; 345/204, 211, 214; 349/143, 149, 86, 88

[56] References Cited

U.S. PATENT DOCUMENTS

| | | | |
|---|---|---|---|
| 5,747,928 | 5/1998 | Shanks et al. | 313/498 |
| 5,777,603 | 7/1998 | Jaeger | 345/184 |
| 5,793,221 | 8/1998 | Aoki | 324/770 |
| 5,821,688 | 10/1998 | Shanks et al. | 313/498 |
| 5,821,690 | 10/1998 | Martens et al. | 313/506 |
| 5,828,427 | 10/1998 | Faris | 349/86 |
| 5,870,162 | 2/1999 | Fujimori et al. | 349/143 |
| 5,909,248 | 6/1999 | Stephenson | 348/373 |
| 5,936,608 | 8/1999 | Springer | 315/169.3 |
| 5,940,156 | 8/1999 | Nishiguchi et al. | 349/86 |
| 5,965,901 | 10/1999 | Heeks et al. | 257/40 |
| 5,977,718 | 11/1999 | Christensen | 315/169.1 |

*Primary Examiner*—Don Wong
*Assistant Examiner*—Thuy Vinh Tran
*Attorney, Agent, or Firm*—Trop, Pruner & Hu, P.C.

[57] ABSTRACT

The degradation of less than all of the pixels of a polymer display may be monitored and the uniformity of the display may be adjusted by either overdriving a given pixel or reducing the light output of other pixels in the display. In this way, the display's lifetime may be maximized without incurring pixel non-uniformity. In addition, the characteristics of the display may be monitored over time in order to provide the user with an early warning of imminent display failure.

30 Claims, 4 Drawing Sheets

CONTROLLING POLYMER DISPLAYS

BACKGROUND

This invention relates generally to polymer displays which have light emitting layers that are semiconductive polymers.

Polymer displays use layers of light emitting polymers. Unlike liquid crystal devices, the polymer displays actually emit light which may make them advantageous for many applications.

Generally polymer displays use at least one semiconductive conjugated polymer sandwiched between a pair of contact layers. The contact layers produce an electric field which injects charge carriers into the polymer layer. When the charge carriers combine in the polymer layer, the charge carriers decay and emit radiation in the visible range.

One semiconductive conjugated polymer that may be used in polymer displays is poly(p-phenylenevinylene) (PPV) which emits green light. Another polymer which emits red-orange light is poly(methylethylhexyloxy-p-phenylenevinylene) (MEH-PPV).

Other polymers of this class are also capable of emitting blue light. In addition nitrile substituted conjugated polymers may be used in forming polymer displays.

It is believed that polymer compounds containing vinyl groups tend to degrade over time and use due to oxidation of the vinyl groups, particularly in the presence of free electrons. Since driving the display with a current provides the free electrons in abundance, the lifetime of the display is a function of total output light. Newer compounds based on fluorine have similar degradation mechanisms that may be related to chemical purity, although the exact mechanism is not yet well known in the industry. In general, polymer displays have a lifetime limit related to the total output light. This lifetime is a function of intrinsic lifetime and the display usage model.

Overdriving the polymer display can increase its useful lifetime because as the display degrades, its output light is increased. overdriving may be done by increasing the display's brightness. However, degradation may introduce output non-uniformity errors. If some of the pixels of the display are degraded non-uniformly, simply overdriving the display does not solve the non-uniform degradation problem. Even after overdriving, some pixels will be brighter than other pixels.

Thus, there is a continuing need for ways of controlling polymer displays that account for non-uniform degradation of individual pixels.

SUMMARY

In accordance with one embodiment, a method for controlling polymer displays includes identifying pixels having reduced output light intensity. The output light intensity of the display is adjusted in view of the presence of pixels having reduced output light intensity.

DETAILED DESCRIPTION

Figure 1:
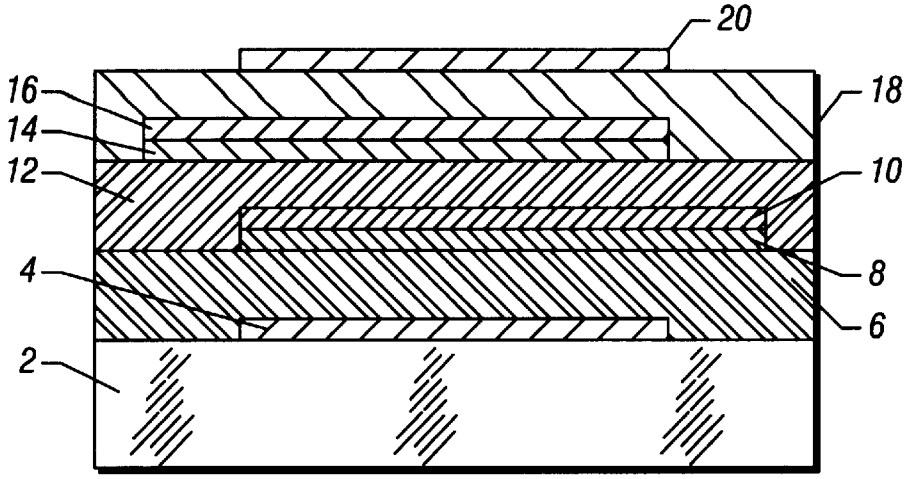
FIG. 1 is an enlarged cross-sectional view of a pixel useful in one embodiment of the present invention.
Figure 2:
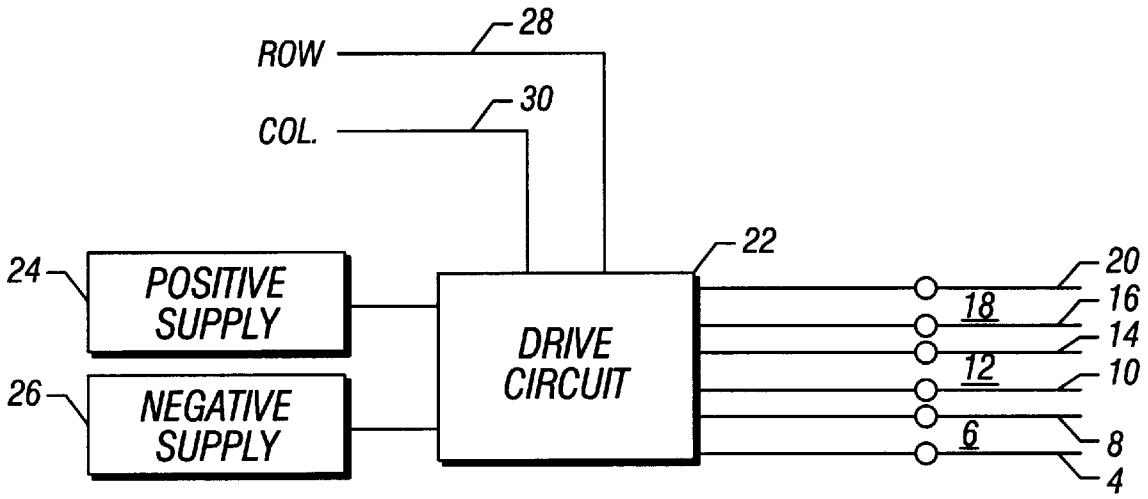
FIG. 2 is a schematic diagram of the drive circuitry that may be utilized with the embodiment shown in FIG. 1.

In one embodiment of the present invention, a polymer display may include a pixel formed of three distinct color emitting layers. In this way, colors may be produced by operating more than one of the layers to provide a "mixed" color or different colors may be produced in a time sequenced pattern so that one pixel may be provided with three color planes using a single compound polymer element. A display of the type shown in FIG. 1 is disclosed in U.S. Pat. No. 5,821,690 to Martens et al. and assigned to Cambridge Display Technology Limited. While techniques discussed in the '690 patent are described herein, other polymer display technologies may be utilized in connection with the present invention as well.

Referring to FIG. 1, a glass substrate 2 supports the remaining layers and issues the output light from the pixel. A layer of transparent conductive material such indium tin oxide 4 may be deposited on the substrate 2 and etched to have a reduced size compared to the dimensions of the substrate 2. A polymer layer 6 may be deposited over the transparent conductive layer 4. The layer 6 may be a semiconductive conjugated polymer such as PPV in one embodiment of the invention. A contact layer 8 may be deposited over the polymer layer 6 to provide the second electrode so an electric field may be applied to the layer 6 by the electrodes 8 and 4. The electrode 8, in one embodiment of the present invention, may be formed of calcium which may be deposited by evaporation through a mask.

On top of the electrode layer 8, a conductive layer 10 is arranged to overlie the layer 8 so that the layers 8 and 10 overlap the layer 4. Again the layer 10 may be defined using conventional etching processes. A second polymer layer 12 may be deposited over the first layer 6 and the electrode layer 10. In one embodiment, the second layer may be MEH-PPV which is designed to produce a second color plane. A second conductive layer 14, which may be formed of calcium in one embodiment, may be defined over the second polymer layer 12 so that the layers 10 and 14 provide the electrodes for controlling light emission from the polymer layer 12.

The electrode 14, which may be calcium in one embodiment, may be covered with a layer 16 of a suitable conductive material such as aluminum. The layer 16 acts as an electrode together with the material 20 for an intermediate layer 18 which may be any blue light emitting polymer layer. Blue light emitting polymer layers may include poly (methylmethacrylate) with a chromophoric polymer such as poly(paraphenylene) or any of the other materials described in U.S. Pat. No. 5,821,690.

Figure 4:
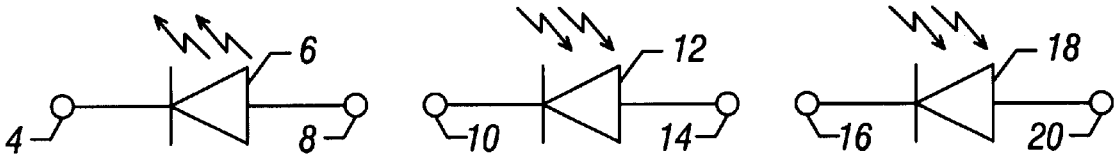
FIG. 4 schematically depicts the polymer display of FIG. 1 in one mode.

Thus, the sandwich of control electrodes and polymer layers may be arranged such that each of three color planes may be produced from a different one of the polymer layers under control of pairs of sandwiching electrodes which apply suitable electric fields to the polymer. For example, referring to FIG. 4, the combinations of electrodes and polymer layers form a composite made of three selectively operable diodes.

The various control electrodes 20, 16, 14, 10, 8 and 4 may be coupled to a drive circuit 22. The drive circuit 22, under control of the row 28 and column 30 address signals, selectively applies either a positive supply voltage 24 or a negative supply voltage 26 to a selected pair of control electrodes 4 and 8, 10 and 14 or 16 and 20. As a result, electrical fields may be selectively applied to the light emitting semiconductive materials 6, 12, and 18.

Thus, any pair of electrodes or any of the polymer layers may be biased to act as a light emitter or as a light detector. When forward biased, the polymer layers act to emit light and when reverse biased the polymer layers detect light radiation. Thus, the individual polymer layers in a given pixel may be caused to either emit light or to detect the light emitted by one of the other polymer layers. This detection of the emitted light may be used to calibrate the display. Particularly, the ability of the layers to detect light may be used to identify polymer layers which have degraded and are producing a lower light output level than other layers in the display.

Figure 3:
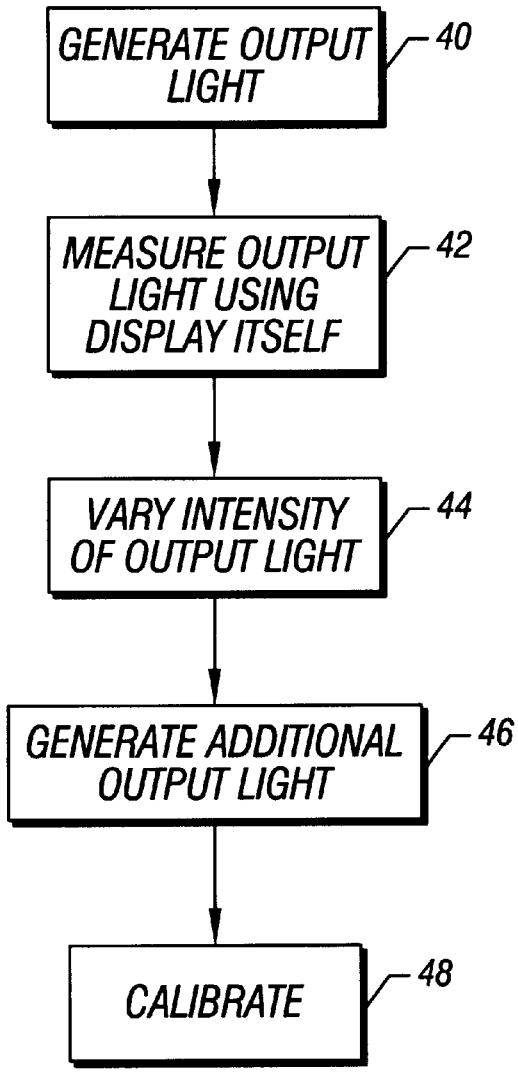
FIG. 3 shows the flow in accordance with one embodiment of the present invention, for calibrating polymer displays.

Referring now to FIG. 3, a technique for calibrating the display by identifying reduced light output levels in particular pixels is illustrated. In one embodiment of the present invention, a sparse checkerboard display pattern may be generated with a given color pixel as indicated at block 40. That is, one pixel and in particular one particular light emitting layer of that pixel may be activated to generate output light. Alternatively, light may be produced from pixels that are spaced sufficiently far away from one another so that their output light does not interfere with the measurement of the output light of other pixels. Thus, a sparse checkerboard display pattern may be created to expedite the calibration process as compared to calibrating a single pixel at a time.

Next, the light generated by a given layer may be detected by other layers within the same pixel in the embodiment shown in FIG. 1. That is, one layer may be forward biased to produce light emission and the remaining layers may be reversed biased, as suggested in FIG. 4, to act as photocells or light detectors. Thus, when the layer 6 emits light, the layers 12 and 18 may detect light and provide a measure of the output light generation. The drive circuit 22 may be operated to apply the appropriate potentials to the electrodes 4, 8, 10, 14 and 16. In addition, adjacent pixels may also be placed in a light detecting mode to provide additional information for assessing the light output of a given pixel.

A suitable mathematical rating algorithm may be generated to rate the effect of different types of pixels in determining the light output of a given layer. For example, based on proximity, layers which are in a light detecting mode within the same pixel may be given a higher weight. However, in some embodiments, adjacent pixels may be given a higher weight based on the fact that they are of the same color as the light emitting layer and therefore in some embodiments, may be more sensitive to the emitted light. Based on the particular display characteristics, equations may be set up which quantify the contributions from various types of sensing elements and those equations may be solved to obtain a measure of the light output of a given excited layer, as indicated in block 42 of FIG. 3.

The emitted output light may be measured without influence from ambient light by varying the intensity of the generated light. By looking at the contribution of various drive currents, an equation may be developed which describes the output light from the given layer. This equation can then use used to determine the output light level without ambient light effects. Regardless of the starting light levels due to the ambient levels, the ability of a given layer to generate output light may be determined as indicated in block 44.

Thereafter, additional elements may be illuminated and similar measurements may be undertaken using the steps described previously, as indicated in block 46. Next, the output light levels may be calibrated as indicated in block 48. In one embodiment of the present invention, a given level of output light is adopted as the temporary standard for all of the pixels. If a given pixel falls below that output, that pixel may be driven harder to raise its output to the desired level. If the pixel is unable to reach the standard level, the light output standard of the display may be reduced.

Since in the embodiment shown in FIG. 1, the various light emitting layers and their respective control electrodes are relatively transparent, two layers can measure the light output from a third layer. In addition, internal reflection, either off the transparent glass substrate or interlayer reflections in the material, may also be used to obtain information from surrounding pixels, if desired.

Figure 5:
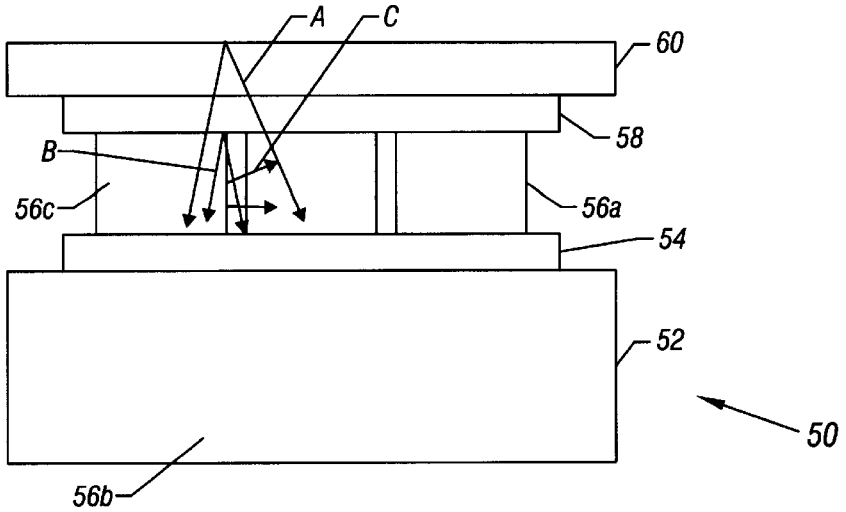
FIG. 5 is an enlarged cross-sectional view of another embodiment useful in connection with the present invention.

In another embodiment of a polymer display which may be used in connection with the present invention, each pixel is made up of three laterally separated polymer elements 56 as illustrated in FIG. 5. A red emitting polymer 56*a*, a blue emitting polymer 56*b* and a green emitting polymer 56*c* may be arranged proximate to one another to provide a single display pixel.

The pixel has an overlying transparent layer 60 on which is coated a transparent electrode such as an indium tin oxide layer 58. The three color planes sit atop another conductive layer 54 which may be aluminum in accordance with one embodiment of the present invention. A substrate 52 may be provided for building up the layers.

The light emitted by one polymer 56 may be detected by other polymers which are oppositely biased. As shown in FIG. 5, the polymers biased to detect light may, for example, detect light reflected off of the layer 60, as indicated by the arrows "A" or off of the layer 58, as indicated by the arrows "B". Also, laterally directed light, indicated by the arrows "C" may also be detected.

Figure 6:
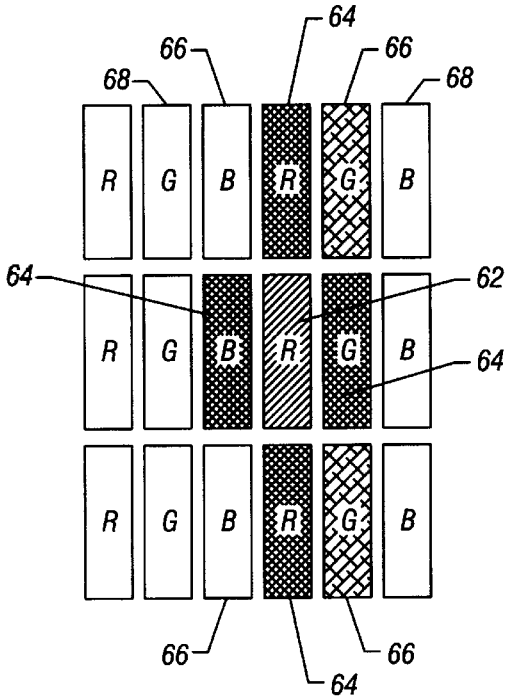
FIG. 6 shows an arrangement of pixels in one embodiment of the present invention.

Referring to FIG. 6, one pixel may then include red, green and blue polymer layers which in one embodiment of the present invention may have an elongate rectangular configuration. Because the red, green and blue color layers are not stacked on top of one another, if the red layer is illuminated as indicated at 62 in FIG. 6, the surrounding layers may be used to detect the emitted radiation. Thus, the red layer may be surrounded in the illustrated embodiment by blue and green layers 64 on either side and red layers 64 on the edges. While the red layers may have the most sensitivity to emitted red light in some embodiments, because of their reduced border length, the adjacent red layers may have a relatively diminished ability to measure the emitted red light in some embodiments.

The surrounding light emitting layers may be classified based on their common border length, their proximity and their color type in evaluating their ability to measure most accurately the emitted radiation. Equations may be developed for a particular display which provide weighting factors for the readings provided by different elements. For example, the blue and green emitting layers 64 may have one factor while the red emitting layers 64 may have a higher factor based on the color identity but a lower factor based on reduced border length. Suburban layers such as the layer 66 may be assigned still another weighting factor and even further outlying layers such as the layers 68 may be provided with still another weighting factor. The information from the surrounding pixels may then be utilized to calculate an accurate measured output light level for the activated pixel layer.

The technique described previously and shown in FIG. 3 may then be used to calibrate each layer of each pixel of the embodiment shown in FIGS. 5 and 6. The accuracy of the measurements may be improved by using an iterative process.

The display may not naturally be able to distinguish between light coming from the display and light coming from the room. The calibration procedure may be performed to separate the variables. Making multiple measurements at varying outputs from the target pixel can aid in providing this information. It may be assumed that the illumination environment is slowly varying and so the output levels should show an intercept from the environmental illumination as well as a slope from the varying output level of the target pixel. Making multiple measurements may substantiate the original assumption of invariance of the ambient light by comparing the intercept as computed from various subsets of data points. If there is a large variation, the data is unreliable and must be repeated.

Next, it is useful to determine to what degree a given display needs to be calibrated. For example, if it can be determined that a newly manufactured display has a sufficiently low non-uniformity noise to be able to assume a flat spatial response, the initial non-uniformity measure may be simply used as a photoresponse calibration. The long term output level degradation may then be tracked and it can be safely assumed that the variation is slowly varying. The output level of a pixel which has not suffered catastrophic failure is not likely to undergo a drastic change in output intensity. This temporal smoothing may be used to keep the noise in the calibration procedure itself from unnecessarily impacting the results. Alternatively, it may be shown that there is a significant non-uniformity noise component. In this case, the use of the calibration procedure may enable the manufacturer to increase the effective yield. This is because if the non-uniformity may be calibrated out, an otherwise unacceptable display may be useable.

The sparsity of the calibration pattern is a function of the time which is available to complete the calibration and its accuracy. If too dense a pattern is used, the pixel may be calibrated with light from another pixel. If too sparse a pattern is used, the calibration time may be too long. In one embodiment of the present invention, a screen saver program may be used to hide long run times in time periods when the machine is not being used. The coupling may depend on the color tiling pattern, the physical size of the display and other parameters.

It may also be desirable to quantify the effect of overdriving the pixel on its degradation cycle. If in a given display it is determined that overdriving is not detrimental, the degrading pixel may be overdriven instead of reducing the light output of the overall display. This issue may be ameliorated by providing the user with a notice if it is predicted that failure is imminent.

Figure 7:
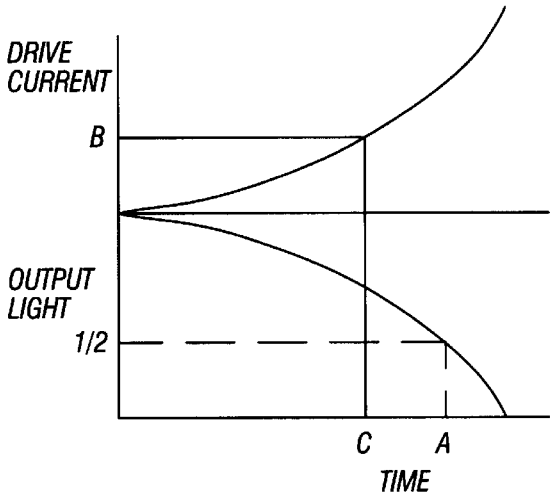
FIG. 7 is a hypothetical graph of output light and drive current versus time for a polymer display.

As shown in FIG. 7, a hypothetical graph of light output level versus time indicates a rate of decline of the display. Generally, when the output light value is reduced in half, as indicated at "A", the device is considered to be at the end of its useful life. The drive current may be compared over time and it may be determined that the slope of the drive current curve over time changes prior to the end of life as indicated at the points B and C in FIG. 7. The system can continually compute the slope of the drive current curve and when the slope abruptly changes, the user may be warned of imminent display end-of-life. This may be done using, for example, a graphical user interface which is displayed on the display.

Figure 8:
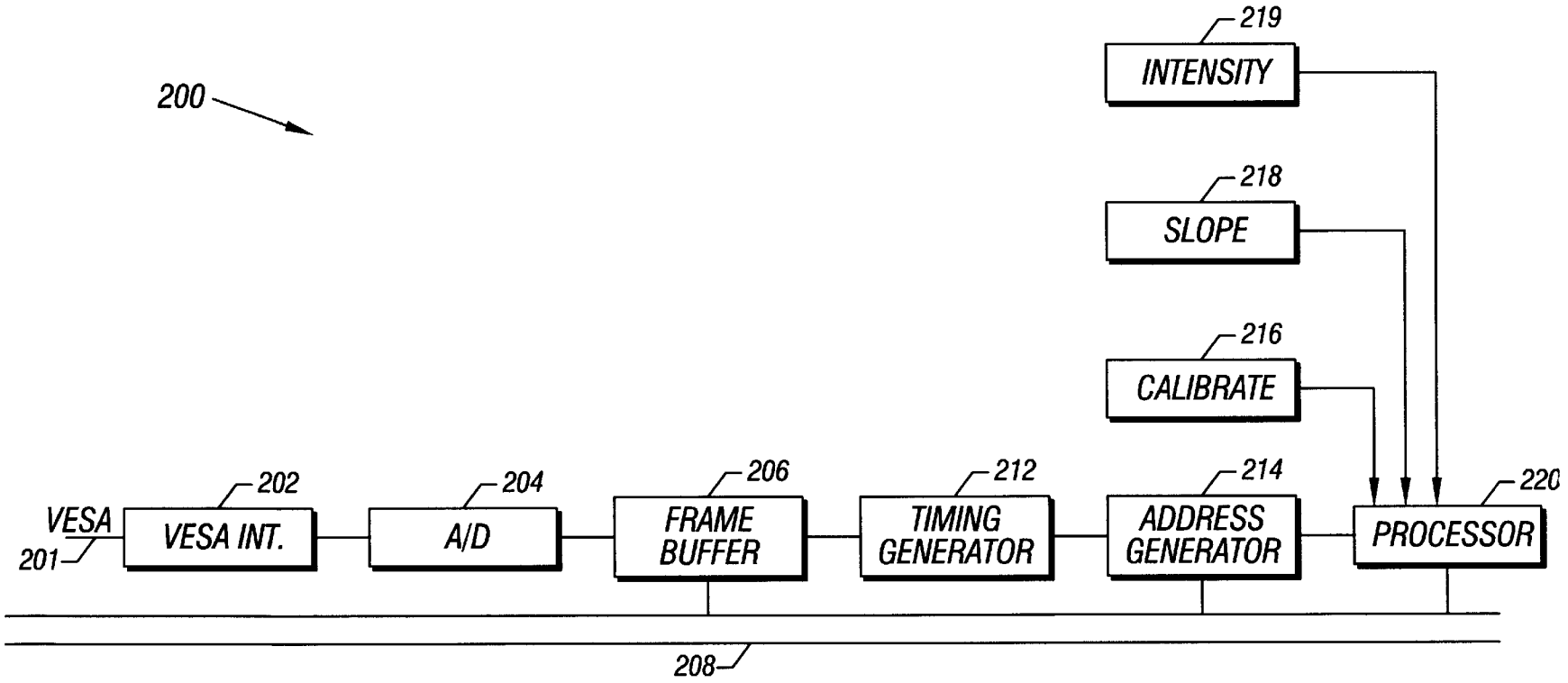
FIG. 8 is a block diagram of a system for implementing one embodiment of the present invention.

Referring to FIG. 8, the display may include an electrical system 200 that may be part of a computer system, for example, or part of a stand-alone system. In particular, the electrical system 200 may include a Video Electronic Standard Association (VESA) interface 202 to receive analog signals from a VESA cable 201. The VESA standard is further described in the Computer Display Timing Specification, V.1, Rev. 0.8 that is available on the Internet at www.vesa.org/standards.html. These analog signals indicate images to be formed on the display and may be generated by a graphics card of a computer, for example. The analog signals are converted into digital signals by an analog-to-digital (A/D) converter 204, and the digital signals may be stored in a frame buffer 206. A timing generator may be coupled to the frame buffer 206 to regulate a frame rate by which images are formed on the screen. A processor 220 may be coupled to the frame buffer 206 via a bus 208.

The processor 220 may process the data stored in the frame buffer 206 to, as examples, calculate the slope of the intensity versus lifetime curve and to provide the end-of-life warning using the software 218. It may also analyze the intensity values determined by various adjacent pixels and apply an algorithm to that data to calculate the measured light output value using the software 219. Similarly, the processor may include an algorithm that enables it to adjust the output light levels of one or more pixels based on information about other pixels, to make the display more uniform, using the software 216. In addition, it may store information in an appropriate memory which provides a standard output light level for the display.

While the present invention has been described with respect to a limited number of embodiments, those skilled in the art will appreciate numerous modifications and variations therefrom. It is intended that the appended claims cover all such modifications and variations as fall within the true spirit and scope of this present invention.

What is claimed is:

1. A method of controlling a polymer display comprising:

identifying pixels in said display having reduced output light intensity relative to other pixels in said display; and adjusting the output light intensity of said display in view of the presence of pixels having reduced output light intensity.

2. The method of claim 1 wherein identifying pixels includes biasing one pixel to emit light and biasing at least one adjacent pixel to measure the emitted light.

3. The method of claim 2 further including measuring the light emitted by one pixel in a stack of pixels producing red, green and blue light.

4. The method of claim 2 further including measuring the light emission from one pixel, in laterally adjacent pixels.

5. The method of claim 4 including statistically weighting the measurement values from adjacent pixels based on the accuracy of the information detected by those pixels.

6. The method of claim 1 further including varying the intensity of the light produced by a given pixel to determine the effect of ambient light on the measured intensity value.

7. The method of claim 1 wherein adjusting the output light intensity includes adjusting the light output of the display to account for the degradation of one pixel compared to other pixels in the display.

8. The method of claim 1 further including causing one pixel to emit light, and causing another pixel to detect light by reverse biasing the other pixel to place it in a light detecting mode.

9. The method of claim 1 wherein identifying pixels includes selectively applying a positive and a negative supply voltage to the control electrodes of a polymer pixel element.

10. An article comprising a medium for storing instructions that cause a processor-based system to:

identify pixels in a polymer display having reduced output light intensity relative to other pixels in said display; and adjust the output light intensity of the polymer display in view of the presence of pixels having reduced output light intensity.

11. The article of claim 10 further including instructions that cause a processor-based system to bias one pixel to emit light and bias at least one adjacent pixel to measure the emitted light.

12. The article of claim 11 further storing instructions that cause a processor-based system to measure the light emitted by one pixel in a stack of pixels producing red, green, and blue light.

13. The article of claim 11 further storing instructions that cause a processor-based system to measure the light emission from one pixel, in laterally adjacent pixels.

14. The article of claim 13 further storing instructions that cause a processor-based system to statistically weight the measurement values from adjacent pixels based on the accuracy of information detected by those pixels.

15. The article of claim 10 further storing instructions that cause a processor-based system to vary the intensity of the light produced by a given pixel to determine the effect of ambient light on the measured intensity value.

16. The article of claim 10 further storing instructions that cause a processor-based system to adjust the light output of the display to account for the degradation of one pixel compared to other pixels in the display.

17. The article of claim 10 further storing instructions that cause a processor-based system to cause one pixel to emit light, and cause another pixel to detect light by reverse biasing the other pixel to place it in a light detecting mode.

18. The article of claim 10 further storing instructions that cause a processor-based system to selectively apply a positive and a negative supply voltage to control electrodes of a polymer pixel.

19. A method of controlling a polymer display comprising:

monitoring a value indicative of imminent end of life; and when said value indicates imminent end of life, indicating to the user that the display is failing.

20. The method of claim 19 including calculating the slope of the curve of applied drive current over time.

21. The method of claim 20 including determining when there is an abrupt change of the slope of the drive current curve.

22. An article comprising a medium for storing instructions that cause a processor-based system to:

monitor a value indicative of the imminent end of life of a polymer display; and when said value indicates imminent end of life, indicate to the user that the display is failing.

23. The article of claim 22 further storing instructions that cause a processor-based system to calculate the slope of the curve of a drive current over time.

24. The article of claim 23, further storing instructions that cause a processor-based system to determine when there is an abrupt change of the slope of the drive current curve.

25. A polymer display comprising:

a plurality of light emitting polymer elements;

drive circuitry adapted to selectively operate said pixel elements in either a light emitting mode or a light detecting mode; and a device adapted to cause one of said elements to emit light and at least one of said other elements to detect the light emitted by said one element.

26. The display of claim 25 wherein each pixel includes a stack of at least two elements producing light of different wavelengths.

27. The display of claim 25 wherein each pixel includes at least two laterally displayed elements producing light of different wavelengths.

28. The display of claim 25 including a detector adapted to detect the end-of-life of the display.

29. The display of claim 25 wherein said device is adapted to sense when one of said pixels is degraded.

30. The display of claim 29 wherein said device is adapted to provide an indicator to the drive circuit to correct the display to account for said degraded pixel.

* * * * *